US010687684B2

(12) United States Patent
Wilson

(10) Patent No.: US 10,687,684 B2
(45) Date of Patent: Jun. 23, 2020

(54) DISHWASHER WITH TINE SPRAYER RINGS

(71) Applicant: Midea Group Co., Ltd., Beijiao, Shunde, Foshan (CN)

(72) Inventor: Mark W. Wilson, Simpsonville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 325 days.

(21) Appl. No.: 15/830,871

(22) Filed: Dec. 4, 2017

(65) Prior Publication Data

US 2019/0167064 A1 Jun. 6, 2019

(51) Int. Cl.

| | |
|---|---|
| ***A47L 15/16*** | (2006.01) |
| ***A47L 15/42*** | (2006.01) |
| ***A47L 15/46*** | (2006.01) |
| ***A47L 15/22*** | (2006.01) |
| ***A47L 15/50*** | (2006.01) |
| ***A47L 15/48*** | (2006.01) |
| ***A47L 15/44*** | (2006.01) |

(52) U.S. Cl.

CPC ..... *A47L 15/16* (2013.01); *A47L 15/22* (2013.01); *A47L 15/4221* (2013.01); *A47L 15/4259* (2013.01); *A47L 15/4285* (2013.01); *A47L 15/4287* (2013.01); *A47L 15/4293* (2013.01); *A47L 15/44* (2013.01); *A47L 15/46* (2013.01); *A47L 15/486* (2013.01); *A47L 15/507* (2013.01); *A47L 2301/00* (2013.01); *A47L 2401/12* (2013.01); *A47L 2401/26* (2013.01); *A47L 2401/34* (2013.01); *A47L 2501/01* (2013.01); *A47L 2501/02* (2013.01); *A47L 2501/03* (2013.01); *A47L 2501/05* (2013.01); *A47L 2501/06* (2013.01); *A47L 2501/07* (2013.01); *A47L 2501/12* (2013.01)

(58) Field of Classification Search

CPC ..... A47L 15/14–23; A47L 15/00–508

See application file for complete search history.

(56) References Cited

U.S. PATENT DOCUMENTS

| | | | | |
|---|---|---|---|---|
| 3,064,664 | A * | 11/1962 | Warhus | A47L 15/23 134/176 |
| 5,409,545 | A | 4/1995 | Levey et al. | |
| 5,522,410 | A | 6/1996 | Meilleur | |

(Continued)

FOREIGN PATENT DOCUMENTS

| | | | |
|---|---|---|---|
| CN | 101049224 | A | 10/2007 |
| CN | 203828876 | U | 9/2014 |

(Continued)

OTHER PUBLICATIONS

International Search Report and Written Opinion issued in Application No. PCT/CN2018/074254 dated Aug. 27, 2018.

(Continued)

*Primary Examiner* — Spencer E Bell

(74) *Attorney, Agent, or Firm* — Middleton Reutlinger

(57) ABSTRACT

A dishwasher utilizing one or more sprayer rings disposed proximate to one or more tines of a dishwasher rack, where the sprayer ring(s) are in fluid communication with a fluid supply that is configured to supply a fluid to the one or more sprayer rings to spray fluid onto utensils disposed within the wash tub.

28 Claims, 9 Drawing Sheets

(56) References Cited

U.S. PATENT DOCUMENTS

| | | | | |
|---|---|---|---|---|
| 6,581,614 | B1 | 6/2003 | Gotfried | |
| 7,210,489 | B2 | 5/2007 | Eiermann | |
| 2007/0235063 | A1 | 10/2007 | Lee et al. | |
| 2008/0011338 | A1 | 1/2008 | Zhao | |
| 2012/0291827 | A1 | 11/2012 | Buddharaju et al. | |
| 2015/0245762 | A1 | 9/2015 | Tuller | |
| 2015/0257623 | A1 | 9/2015 | Beshears, Jr. et al. | |
| 2015/0272421 | A1 | 10/2015 | Benedict et al. | |
| 2015/0366430 | A1* | 12/2015 | Ross | A47L 15/428 134/169 R |
| 2016/0302643 | A1 | 10/2016 | Mersch | |
| 2017/0007094 | A1 | 1/2017 | Boyer | |

FOREIGN PATENT DOCUMENTS

| | | | |
|---|---|---|---|
| WO | 2014107123 | A1 | 7/2014 |
| WO | 2017080583 | A1 | 5/2017 |

OTHER PUBLICATIONS

GE Appliances, GE GDT695SM JES, https://www.ajmadison.com/cgi-bin/ajmadison/GDT695SMJES.html, retreived Jul. 13, 2017.

Yu, Johnny, "Electrolux EI24ID50QS Dishwasher Review: Innovation and excellence," Reviewed.com Dishwashers, http://dishwashers.reviewed.com/content/electrolux-ei24id50qs-dishwasher-review, Jun. 10, 2014.

KitchenAid, "44 dBA Dishwasher with Dynamic Wash Arms and Bottle Wash," https://www.kitchenaid.com/shop/-[KDTM704ESS]-5571597/KDTM704ESS/, retrieved Jul. 13, 2017.

* cited by examiner

DISHWASHER WITH TINE SPRAYER RINGS

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the short coming of that they must spread the wash fluid over all areas equally to achieve a satisfactory result. In doing so resources such as time, energy and water are generally wasted because wash fluid cannot be focused precisely where it is needed. In particular, it may be difficult for traditional spray arms to effectively spread wash fluid to the interior surfaces of some utensils, for example bottles, cups, and the like.

SUMMARY

The herein-described embodiments address these and other problems associated with the art by providing a dishwasher utilizing one or more sprayer rings that are coupled to a fluid supply. In some aspects, a dishwasher described herein includes: a wash tub; one or more racks positioned within the wash tub, where the one or more racks further include one or more tines; one or more sprayer rings disposed proximate the one or more tines; and a fluid supply in fluid communication with the one or more sprayer rings and configured to supply a fluid to the one or more sprayer rings to spray the fluid onto utensils disposed within the wash tub.

In some embodiments, the one or more sprayer rings circumscribe the one or more tines. In other embodiments, the one or more sprayer rings include a plurality of tiered sprayer rings circumscribing a same tine among the one or more tines. In still other embodiments, the one or more sprayer rings are positioned under the one or more tines. In some embodiments, the one or more sprayer rings are positioned adjacent the one or more tines.

In some embodiments, the one or more sprayer rings are affixed to the one or more tines. In some embodiments, the one or more one or more sprayer rings are affixed to the one or more tines through one or more fasteners. In other embodiments, the one or more sprayer rings are affixed to the one or more tines though an adhesive. In still other embodiments, the one or more sprayer rings are affixed to the one or more tines through one or more attachment clips.

In some embodiments, each of the one or more sprayer rings includes at least one nozzle. In some embodiments, the at least one nozzle is vertically oriented. In other embodiments, the at least one nozzle is horizontally oriented.

In some embodiments, the dishwasher further includes a controller coupled to the fluid supply. In some embodiments, the controller is configured to control the fluid supply to selectively spray fluid through the one or more sprayer rings.

In some embodiments, the dishwasher further includes a dock and a docking port, where the docking port is positioned on a wall of the wash tub, and where the one or more sprayer rings are in fluid communication with the dock through a supply tube, where the supply tube and the dock are supported by a rack among the one or more racks, and where the dock engages with the docking port when the rack is in an operative position. In other embodiments, the dishwasher further includes a hose extending from a fluid supply to the one or more sprayer rings.

In another aspect, a dishwasher described herein includes: a wash tub; a docking port positioned on a wall of the wash tub; a supply tube, where the supply tube includes a first end and a second end; a dock coupled to the first end of the supply tube and capable of coupling the supply tube to the docking port; one or more sprayer rings in fluid communication with the second end of the fluid supply; and a fluid supply in fluid communication with the one or more sprayer rings through the docking port, the dock and the supply tube and configured to supply a fluid to the one or more sprayer rings to spray the fluid onto utensils disposed within the wash tub.

In another aspect, a dishwasher described herein includes: a wash tub; a supply tube; a sprayer ring, where the sprayer ring comprises a ring-shaped body and one or more nozzles, and where the sprayer ring is in fluid communication with the supply tube; and a fluid supply in fluid communication with the sprayer ring through the supply tube and configured to supply a fluid to sprayer ring to spray the fluid onto utensils disposed within the wash tub.

These and other advantages and features, which characterize the invention, are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

In some embodiments consistent with the invention, one or more sprayer rings may spray a fluid such as a wash liquid into a wash tub of a dishwasher during a wash cycle. A sprayer ring, in this regard, may be considered to include a main body, which in some instances may generally be circular, and has one or more apertures disposed on an exterior surface thereof and is in fluid communication with a fluid supply, e.g., through one or more internal passageways defined therein. Although the term "sprayer ring" is used throughout, this is not intended to be limited to a circular shape; the sprayer ring may be generally square or any number of other shapes. Furthermore, the sprayer ring may include one or more channels that at least partially circumscribe a void. In some embodiments, the main body of the sprayer ring forms a complete ring, and may have a single open channel that connects with itself. In other embodiments, the sprayer ring may include two channels that may be separated by a wall. In still other embodiments, the sprayer ring may include an opening that may not be fully circumscribed, for example the sprayer ring may be shaped like a "C". In addition, the one or more apertures on the exterior surface of a sprayer ring may be arranged into nozzles in some embodiments, which may be fixed or movable (e.g., rotating, oscillating, etc.).

Figure 1:
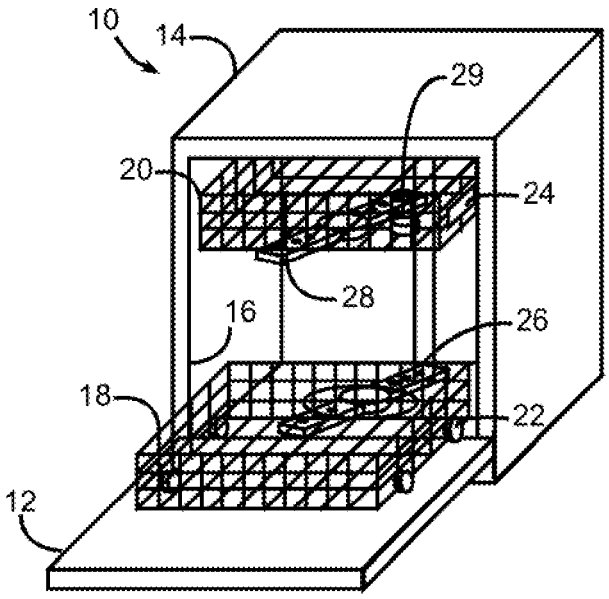
FIG. 1 is a perspective view of a dishwasher consistent with some embodiments of the invention.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more sprayer rings 29 to direct a wash fluid onto utensils disposed in racks 18, 20. As will become more apparent below, sprayer rings 29 may be in fluid communication with a dock and docking port positioned on a wall of the wash tub 16 through one or more supply tubes 26. The sprayer rings may be positioned in a particular zone or area of the dishwasher (e.g. in the upper rack), and may be used in combination with one or more rotating spray arms, e.g., upper spray arm 28 or other sprayers, including various combinations of wall-mounted sprayers, rack-mounted sprayers, oscillating sprayers, fixed sprayers, rotating sprayers, focused sprayers, etc. However, this positioning is not intended to be limiting, and in some embodiments the sprayer rings may be positioned through the dishwasher with, or without, the use of additional sprayers.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
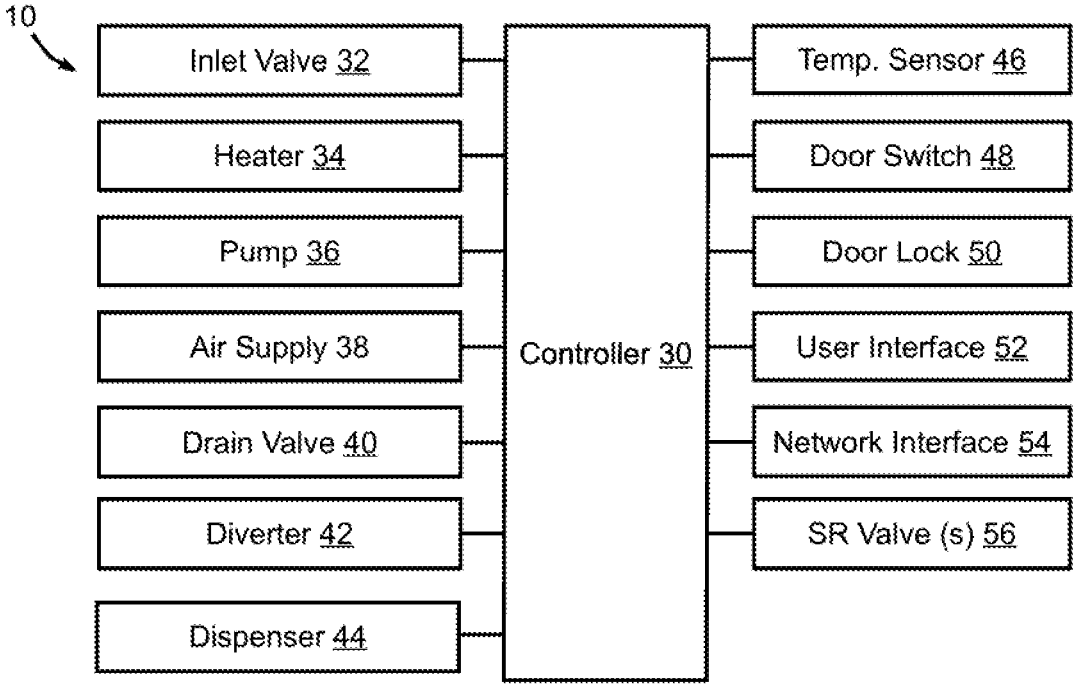
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, Include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that may provide a source of pressurized air for use in drying utensils in the dishwasher, a drain valve 40 that is coupled to a drain to direct fluids out of the dishwasher, and a diverter 42 that controls the routing of pumped fluid to different sprayer rings, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. Air supply 38 may be implemented as an air pump or fan in different embodiments, and may include a heater and/or other air conditioning device to control the temperature and/or humidity of the pressurized air output by the air supply.

In some embodiments, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, sprayer rings may be used solely for spraying wash fluid or spraying pressurized air, with other sprayers or spray arms used for other purposes.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more sprayer ring (SR) valves 56 may be provided in some embodiments to discretely control the flow of fluid to one or more sprayer rings 29 disposed in dishwasher 10.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher 10 illustrated in FIGS. 1 and 2 will be apparent to one of ordinary skill in the art, as will become apparent from the description below. Therefore, the invention is not limited to the specific implementations discussed herein.

Figure 3:
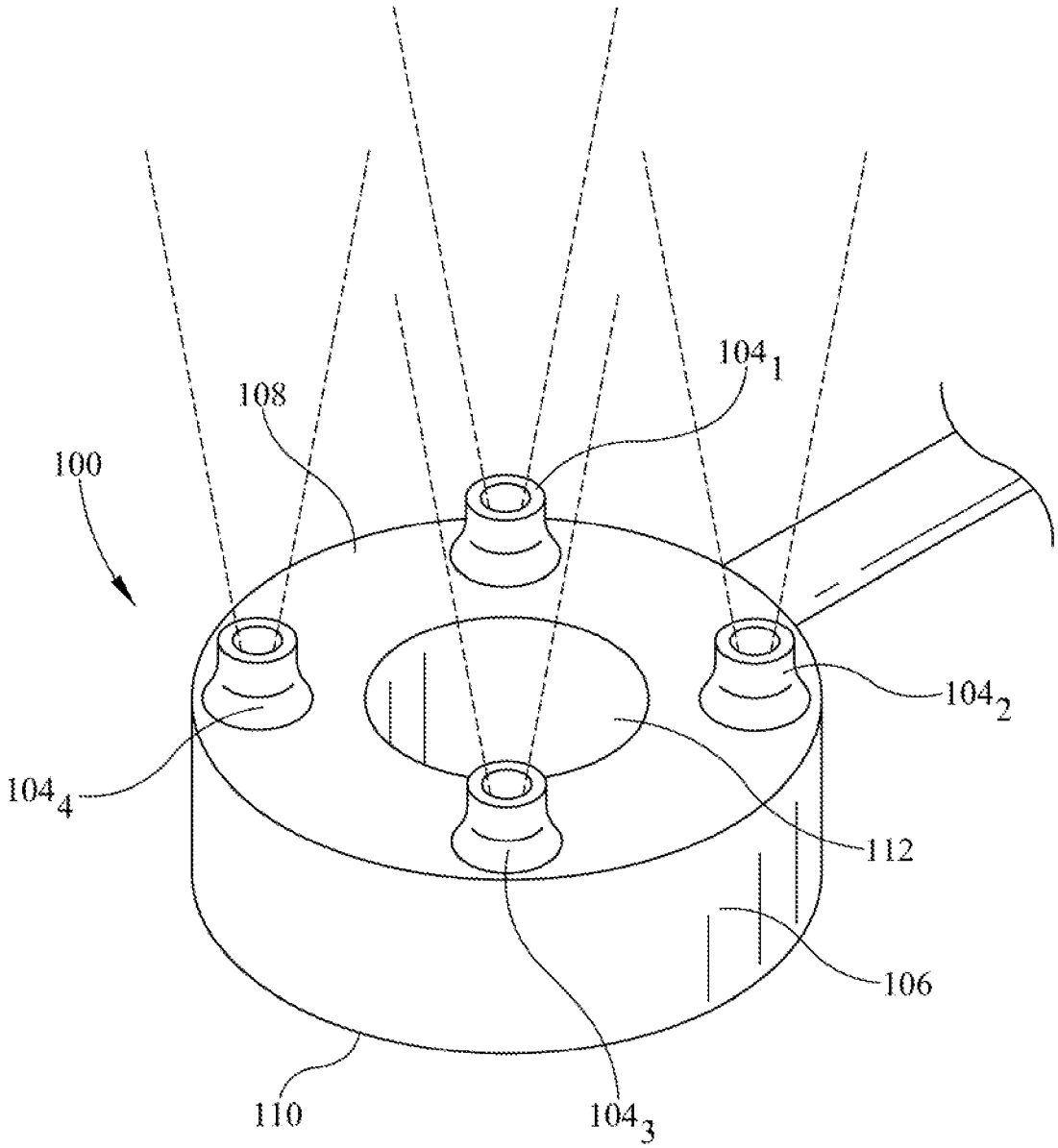
FIG. 3 is a perspective view of a sprayer ring consistent with some embodiments of the invention.

Now turning to FIG. 3, a dishwasher may include one or more sprayer rings 100. As illustrated in FIG. 3, the sprayer ring 100 may include a main body portion 106 defined by an upper surface 108 and a lower surface 110. The main body 106 of the sprayer ring 100 may be generally circular or cylindrical in shape; however, this is not to be understood as limiting. In some embodiments, the sprayer ring may include an opening 112 extending through the main body portion 106 from the upper surface 108 to the lower surface 110. In some embodiments, this opening 112 may also be circular or cylindrical in shape, and may result in a generally "donut" shape appearance to the sprayer ring; however, the invention is not so limited. In other embodiments, the opening 112 may be shaped so as to receive a tine of a dishwasher rack, and thus in some instances, take on the shape of the tine. Additionally, the sprayer ring may include one or more apertures $\mathbf{104}_{1\text{-}n}$.

The sprayer ring 100 may have a generally hollow interior, or at least include one or more internal fluid passages that are in fluid communication with the one or more apertures $\mathbf{104}_{1\text{-}n}$ extending through an exterior surface thereof. Each aperture $\mathbf{104}_{1\text{-}n}$ may function to direct a spray of fluid into the wash tub, and each aperture may be configured in various manners to provide various types of spray patterns, e.g., streams, fan sprays, concentrated sprays, etc. In some instances it may be desirable for apertures $\mathbf{104}_{1\text{-}n}$ to be configured as nozzles, for example fluidic nozzles that may provide oscillating spray patterns. In some embodiments, one or more of these apertures $\mathbf{104}_{1\text{-}n}$ may be horizontally oriented; while in other embodiments, one or more of these apertures $\mathbf{104}_{1\text{-}n}$ may be vertically oriented. As will be discussed in greater detail herein, in some embodiments, one or more sprayer rings may be positioned proximate, and/or connected to one or more tines of a dishwasher rack.

Figure 4:
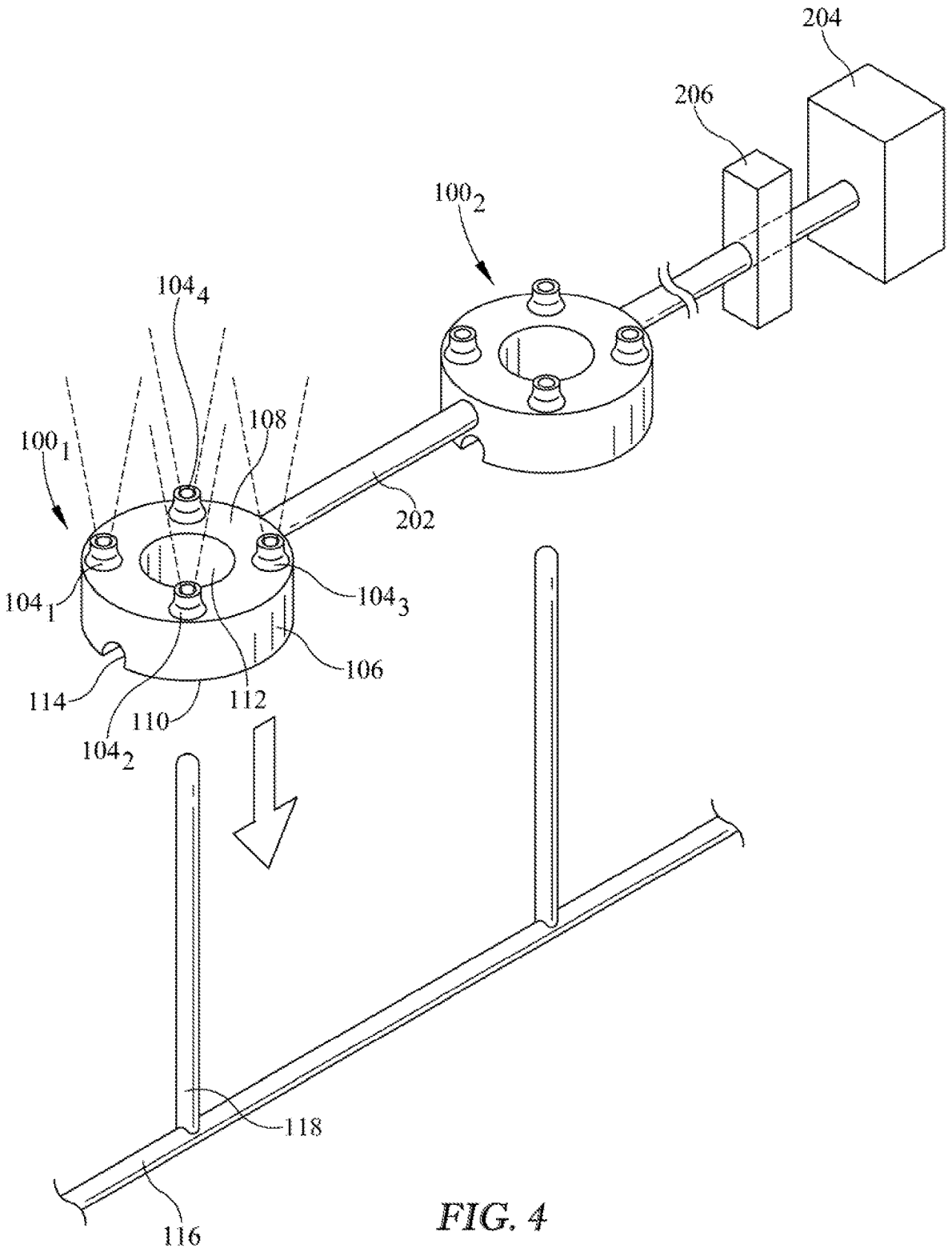
FIG. 4 is a partial perspective view of a dishwasher rack, tines, and sprayer rings consistent with some embodiments of the invention in an uninstalled position.
Figure 5:
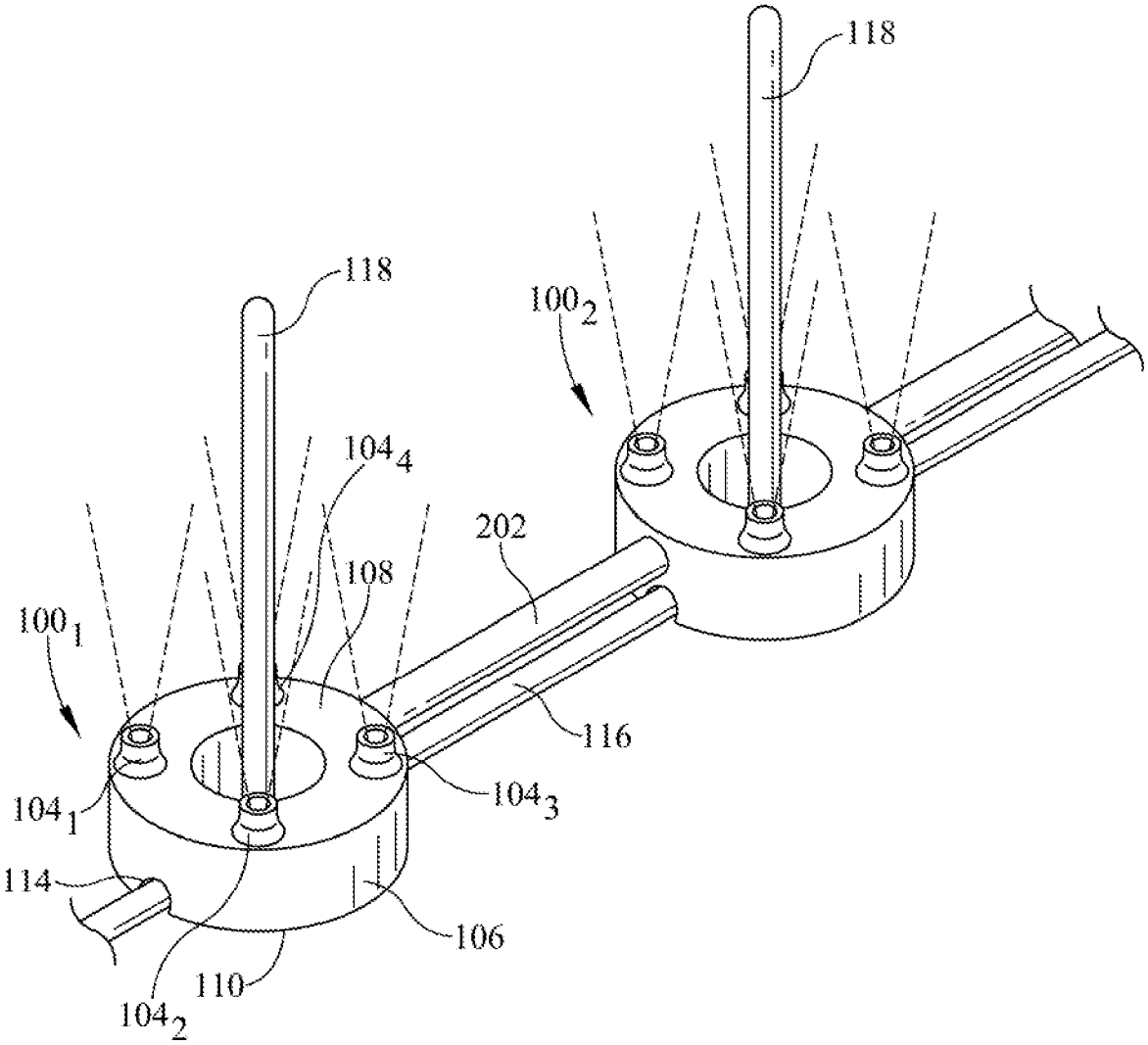
FIG. 5 is a partial perspective view of the embodiment of FIG. 4 in an installed position.

Now turning to FIGS. 4 and 5, in some embodiments, the one or more sprayer rings $\mathbf{100}_{1\text{-}n}$ may be coupled with a supply tube 202 that is in fluid communication with a fluid supply 204. In such embodiments, the supply tube 202 may be configured as a tube or other elongated body (e.g. a hose) disposed in a wash tub 16. In addition, the supply tube 202 may be generally hollow, or at least includes one or more internal fluid passages that are in fluid communication with the one or more sprayer rings $\mathbf{100}_{1\text{-}n}$. In some embodiments, it may be desirable incorporate a valve 206 between the supply tube 202 and fluid supply 204 in order to regulate the fluid flow to the one or more sprayer rings $\mathbf{100}_{1\text{-}n}$, although it should be appreciated that such a valve is not required. Valve 206 may be an on/off valve in some embodiments or may be a variable valve to control flow rate in other embodiments. In still other embodiments, a valve may be external to or otherwise separate from the supply tube 202, and may either be dedicated to the supply tube or used to control multiple supply tubes. In still other embodiments, each sprayer ring $\mathbf{100}_{1\text{-}n}$ may include a dedicated valve 206.

In some embodiments, such as Illustrated in FIGS. 4 and 5, the main body 106 of the one or more sprayer rings $\mathbf{100}_{1\text{-}n}$ may fit over, or circumscribe, one or more tines 118 of a dishwasher rack 116. In such embodiments, the sprayer ring 100 may also include an additional opening or cut-out 114 configured to receive or couple with the dishwasher rack 116 from which the tine 118 extends. Such an opening or cut-out may extend vertically from the lower surface 110 of the main body 106 toward the upper surface 108. In some embodiments, this opening or cut-off may not fully extend to the upper surface, but rather may be semi-circular in shape stopping generally mid-way between the upper 108 and lower 110 surfaces, but it is not so limited. Such a cut-out 114 may allow one or more the sprayer rings $\mathbf{100}_{1-n}$ to sit flush with the rack 116 and around the tine 118, with minimal gap between the rack 116 and the supply tube when in an installed position, as illustrated in FIG. 5. An opening or cut-out may also be configured to snap onto the rack 116 in some embodiments such that the sprayer ring $\mathbf{100}_{1-n}$ is secured to the rack. In other embodiments, additional fasteners, tabs or other mechanical couplings may be used to assist with securing a sprayer ring $\mathbf{100}_{1-n}$ to a rack 116.

Figure 6:
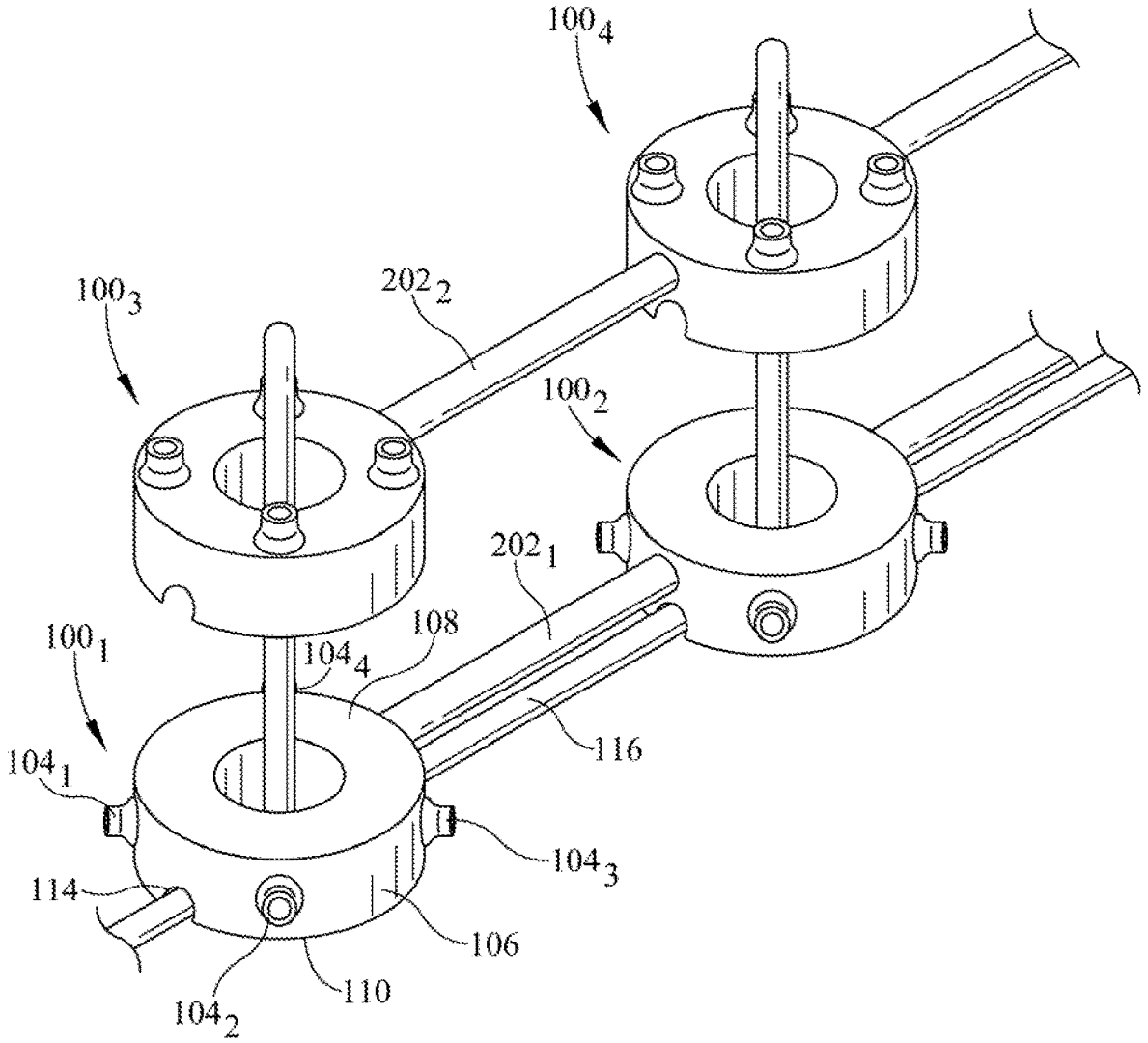
FIG. 6 is a partial perspective view of a dishwasher rack, tines, and sprayer rings consistent with some embodiments of the invention.

In some embodiments, such as illustrated in FIG. 6, there may be a plurality of sprayer rings $\mathbf{100}_{1-n}$ tiered on the one or more tines, such that the plurality of sprayer rings circumscribe the same tine 118 on the dishwasher rack 116. In some embodiments, one or more of the apertures 104 of the sprayer rings $\mathbf{100}_{1-n}$ may spray fluid in a horizontal direction (e.g. $\mathbf{100}_3$ and $\mathbf{100}_4$), while other apertures 104 of the one or more sprayer rings $\mathbf{100}_{1-n}$ may spray fluid in a vertical direction ((e.g. $\mathbf{100}_1$ and $\mathbf{100}_2$). For example, in some instances such an arrangement may be desirable where the length of the tine 118 is long, as compared to other tines. Although illustrated as having a supply tube $\mathbf{202}_1$, $\mathbf{202}_2$ for each tier, this is not intended to be limiting. For example, in some instances it may be desirable to feed all of the sprayer rings $\mathbf{100}_{1-n}$ on a single tine with the same supply tube 202.

Figure 7:
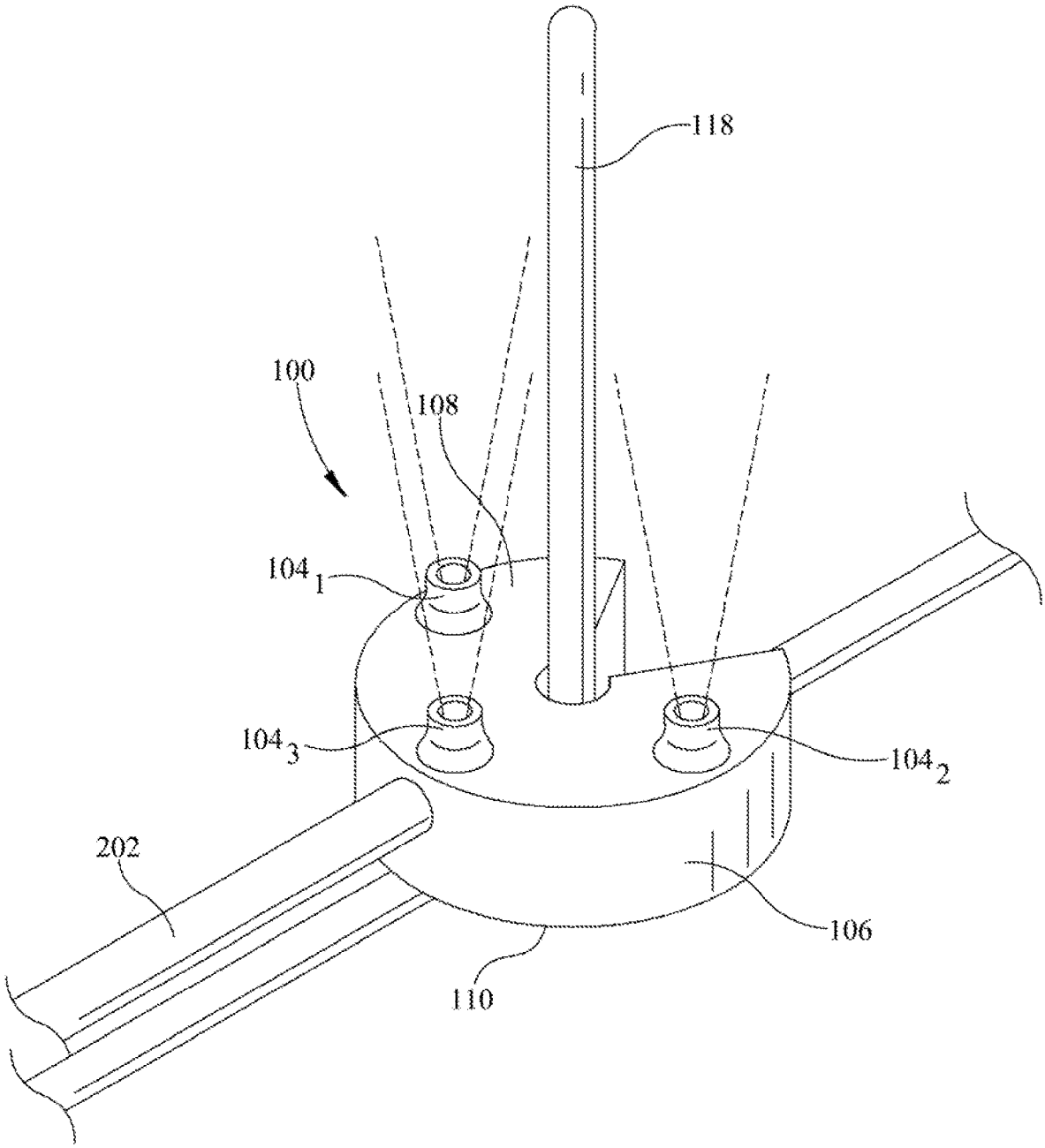
FIG. 7 is a partial perspective view of a dishwasher rack, tines, and sprayer rings consistent with some embodiments of the invention.

In other embodiments, one or more sprayer rings may be positioned adjacent to one or more tines. As used herein adjacent may indicate the entirety of the main body of the sprayer ring is adjacent to the tine; or, as illustrated in FIG. 7, adjacent may be used to describe a sprayer ring that includes an opening that may not be fully circumscribed, for example where the sprayer ring is shaped like a "C". In such embodiments, the one or more sprayer rings may be attached or coupled to the dishwasher rack itself from the side, rather than from the top or the bottom of the sprayer rings, as illustrated in other embodiments described herein. Other manners of affixing sprayer rings to various elements of a dishwasher rack, including various fasteners, clips, etc., may be used in other embodiments, as will be appreciated by those of ordinary skill having the benefit of the instant disclosure.

Figure 8:
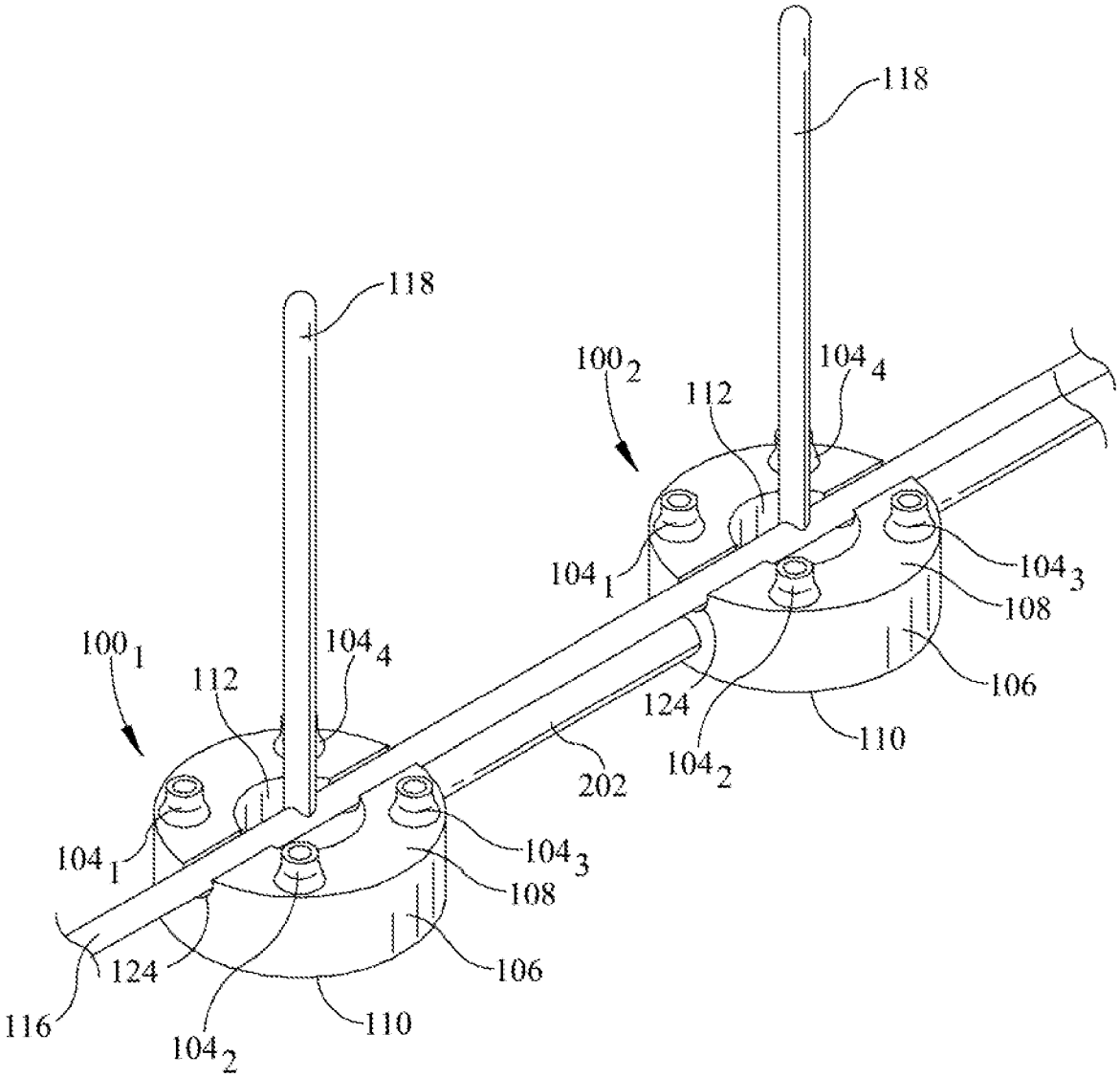
FIG. 8 is a partial perspective view of a dishwasher rack, tines, and sprayer rings consistent with some embodiments of the invention.

In still other embodiments, such as illustrated in FIG. 8, the main body 106 of the one or more sprayer rings $\mathbf{100}_{1-n}$ may fit under and/or couple with, one or more tines 118 of a dishwasher rack 116. In such embodiment, the sprayer ring 100 may also include a concave indention 124, configured to receive and/or couple with the dishwasher rack 116 from which the tine 118 extends. Such a concave indention 124 may be located on the upper surface 108 of the sprayer ring 100 and extend vertically into the main body 106 and may not fully extend to the lower surface 110. In some embodiments, this indention 124 may be semi-circular of cylindrical in shape, but it is not so limited. Such an indention 114 may allow the sprayer ring 100 to sit flush on the tine 118, with minimal gap between the rack 116 and the sprayer ring 100 when the sprayer ring 100 is positioned below the tine 118 and rack 116.

In the various embodiments described above, the one or more sprayer rings $\mathbf{100}_{1-n}$ may be affixed to the one or more tines 118 and or the dishwasher rack 116. In some embodiments, the one or more sprayer rings $\mathbf{100}_{1-n}$ may be affixed to the one or more tines through one or more fasteners. Fasteners may include, but are not limited to, screws, bolts, clamps, or the like. Fasteners may be constructed of any material suitable in the art, including various metals, plastics, or the like. In other embodiments, the one or more sprayer rings $\mathbf{100}_{1-n}$ may be affixed to the one or more tines 118 through one or more attachment clips, which may allow for the one or more sprayer rings $\mathbf{100}_{1-n}$ to "snap" or lock into place, for example onto or under a tine. Attachment clips may also be constructed of any material suitable in the art, including various metals, plastics, or the like. In still other embodiments, the one or more sprayer rings $\mathbf{100}_{1-n}$ may be affixed to the one or more tines 118 through use of an adhesive. Any type of adhesive known in the art may be used, including, but not limited to epoxies, polyurethane, or the like.

Figure 9:
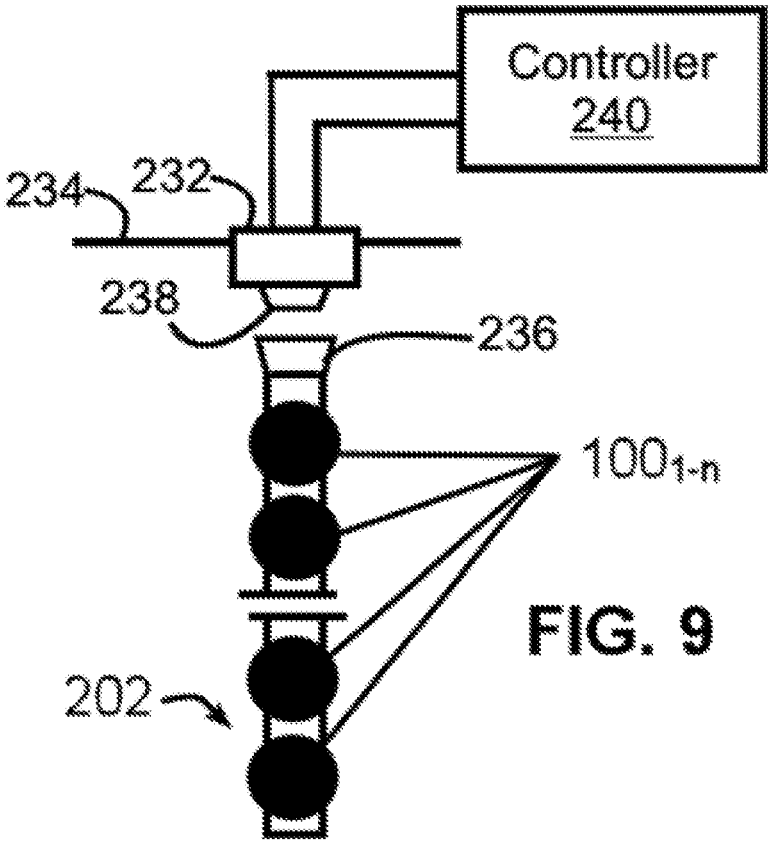
FIG. 9 is a functional top plan view of another example implementation of sprayer rings consistent with some embodiments of the invention.

Now turning to FIG. 9, the one or more sprayer rings $\mathbf{100}_{1-n}$ may be positioned, and receive fluid flow within a wash tub in various manners in different embodiments. As illustrated by FIGS. 4-8 (discussed above), a sprayer ring 100 in some embodiments may be affixed to a tine 118 (e.g. circumscribe, under, adjacent, or the like) or to a rack 116 itself. Moreover, as discussed previously, in some embodiments, the one or more sprayer rings $\mathbf{100}_{1-n}$ may be coupled with a supply tube 202 that is in fluid communication with a fluid supply 204. This supply tube 202 may be configured as a tube or other elongated body (e.g. a hose) with a first end 214 and a second end portion 216 disposed in a wash tub 16. In some embodiments, a supply tube may be mountable on a rack (for example, through one or more sprayer rings $\mathbf{100}_{1-n}$). FIG. 9, for example, illustrates a supply tube 202, and associated sprayer rings $\mathbf{100}_{1-n}$ capable of being mounted on rack (not shown) and dockable via a dock 236 positioned at the first end 214 of the supply tube 202 to a docking port 238 on a wall 234 of a wash tub. The dock 236 and docking port 238 provide fluid communication with the supply tube 202, and thus the associated sprayer rings $\mathbf{100}_{1-n}$ located on the second end portion 216 of the supply tube 202. Control over supply tube and associated one or more sprayer rings $\mathbf{100}_{1-n}$ is provided by a controller 240. Although only one supply tube 202 is illustrated in FIG. 9, this is not intended to be limiting. Any number of supply tubes may be present in a dishwasher.

In some embodiments, the fluid supplied to the sprayer rings may be a liquid, a gas, or a combination of the two. For example, in some embodiments, the sprayer rings $\mathbf{100}_{1-n}$ may be used to dispense a liquid wash fluid to clean utensils; while in other embodiments, the sprayer rings may be used to dispense a gas (e.g. heated atmospheric air) in order to dry clean utensils. In some embodiments, liquid and gas may be supplied concurrently, while in some embodiments, liquid and gas may be supplied selectively (e.g., at different phases of a wash cycle). In still other embodiments, a sprayer ring may include two sets of nozzles fed by independent supply tubes in order to provide liquid and gas to the same sprayer ring out of different nozzles.

Figure 10:
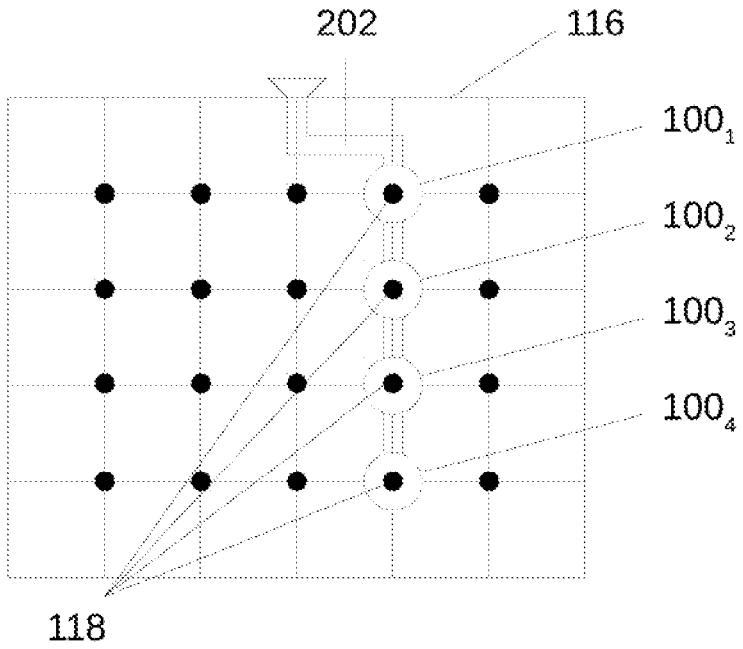
FIG. 10 is a top view of a dishwasher rack, tines, and sprayer rings consistent with some embodiments of the invention.

It will be appreciated that sprayer rings may be disposed at various locations within a dishwasher, including on or proximate dishwasher racks, one or proximate the walls of a wash tub, or in other locations that will be appreciated by those of ordinary skill in the art having the benefit of the instant disclosure. Moreover, multiple sprayer rings may be arranged in various configurations and may be placed in fluid communication with a fluid supply using various combinations of supply tubes, manifolds, valves, docking ports, etc. Sprayer rings may be used in some embodiments for primary or general washing operations, while in other embodiments sprayer rings may be used to provide specialized washing operations such as bottle or glass wash operations, pot scrubbing operations, specialized washing zones, etc. In one example and non-limiting embodiment, sprayer rings may be arranged in a linear array on an upper dishwasher rack to provide a specialized bottle or glass washing operation in a dishwasher. FIG. 10, for example, illustrates a top view of a dishwasher rack 116, which may include a plurality of sprayer rings $\mathbf{100}_{1-n}$ disposed over, or circumscribing, a plurality of tines 118 of the dishwasher rack 116. Sprayer rings $\mathbf{100}_{1-n}$ are coupled with a supply tube 202 that extends rearwardly through rack 116 and includes a rearwardly-disposed transverse section that aligns with a centrally-located dock configured to mate with a docking port on a rear wall of a wash tub (not shown in FIG. 10) to provide fluid (e.g. liquid or gas) to the plurality of sprayer rings $\mathbf{100}_{1-n}$. It will be appreciated, however, that sprayer rings may be used in a multitude of other applications, so the invention is not limited to the particular implementation illustrated in FIG. 10.

Various additional modifications may be made to the illustrated embodiments consistent with the invention. Therefore, the invention lies in the claims hereinafter appended.

What is claimed is:

1. A dishwasher, comprising:

a wash tub;

one or more racks positioned within the wash tub, wherein the one or more racks further comprise one or more tines;

one or more sprayer rings disposed proximate the one or more tines, each sprayer ring including at least one nozzle and one or more channels that at least partially circumscribe a void and that communicate fluid to the at least one nozzle, wherein the one or more sprayer rings are separate from and circumscribe the one or more tines, wherein the void of each sprayer ring has a diameter that is at least as large as that of the tine to which such sprayer ring is proximate, and wherein a longitudinal axis of the tine to which such sprayer ring is proximate extends through the void;

a fluid supply in fluid communication with the one or more sprayer rings and configured to supply a fluid to the one or more sprayer rings to spray the fluid onto utensils disposed within the wash tub.

2. The dishwasher of claim 1, wherein each of the one or more tines is solid.

3. The dishwasher of claim 1, wherein the one or more sprayer rings includes a plurality of tiered sprayer rings circumscribing a same tine among the one or more tines.

4. The dishwasher of claim 1, wherein the one or more sprayer rings are positioned under the one or more tines.

5. The dishwasher of claim 1, wherein the one or more sprayer rings are positioned adjacent the one or more tines.

6. The dishwasher of claim 1, wherein the one or more sprayer rings are affixed to the one or more tines.

7. The dishwasher of claim 6, wherein the one or more one or more sprayer rings are affixed to the one or more tines through one or more fasteners.

8. The dishwasher of claim 6, wherein the one or more sprayer rings are affixed to the one or more tines through an adhesive.

9. The dishwasher of claim 6, wherein the one or more sprayer rings are affixed to the one or more tines through one or more attachment clips.

10. The dishwasher of claim 1, wherein the at least one nozzle is vertically oriented.

11. The dishwasher of claim 1, wherein the at least one nozzle is horizontally oriented.

12. The dishwasher of claim 1, further comprising a controller coupled to the fluid supply.

13. The dishwasher of claim 12, wherein the controller is configured to control the fluid supply to selectively spray fluid through the one or more sprayer rings.

14. The dishwasher of claim 1, wherein the dishwasher further comprises a dock and a docking port, wherein the docking port is positioned on a wall of the wash tub, and wherein the one or more sprayer rings are in fluid communication with the dock through a supply tube, wherein the supply tube and the dock are supported by a rack among the one or more racks, and wherein the dock engages with the docking port when the rack is in an operative position.

15. The dishwasher of claim 1, wherein the dishwasher further comprises a hose extending from a fluid supply to the one or more sprayer rings.

16. A dishwasher, comprising:

a wash tub;

a docking port positioned on a wall of the wash tub;

a supply tube, wherein the supply tube comprises a first end and a second end;

a dock coupled to the first end of the supply tube and capable of coupling the supply tube to the docking port;

one or more sprayer rings in fluid communication with the second end of the supply tube, each sprayer ring including at least one nozzle and one or more channels that at least partially circumscribe a void and that communicate fluid to the at least one nozzle, wherein the one or more sprayer rings circumscribe one or more tines disposed on a rack positioned within the wash tub, wherein the one or more sprayer rings are separate from and circumscribe the one or more tines, wherein the void of each sprayer ring has a diameter that is at least as large as that of the tine to which such sprayer ring is proximate, and wherein a longitudinal axis of the tine to which such sprayer ring is proximate extends through the void; and a fluid supply in fluid communication with the one or more sprayer rings through the docking port, the dock and the supply tube and configured to supply a fluid to the one or more sprayer rings to spray the fluid onto utensils disposed within the wash tub.

17. The dishwasher of claim 16, wherein each of the one or more tines is solid.

18. The dishwasher of claim 17, wherein the one or more sprayer rings are positioned under the one or more tines.

19. The dishwasher of claim 17, wherein the one or more sprayer rings are positioned adjacent the one or more tines.

20. The dishwasher of claim 17, wherein the one or more sprayer rings are affixed to the one or more tines.

21. The dishwasher of claim 16, wherein the one or more sprayer rings includes a plurality of tiered sprayer rings circumscribing a same tine among the one or more tines.

22. The dishwasher of claim 16, wherein the at least one nozzle is vertically oriented.

23. The dishwasher of claim 16, wherein the at least one nozzle is horizontally oriented.

24. The dishwasher of claim 16, further comprising a controller coupled to the fluid supply.

25. The dishwasher of claim 24, wherein the controller is configured to control the fluid supply to selectively spray fluid through the one or more sprayer rings.

26. A dishwasher, comprising:

a wash tub;

a supply tube;

a sprayer ring, wherein the sprayer ring comprises a generally C-shaped body, one or more nozzles, and one or more channels that at least partially circumscribe a void and that communicate fluid to the at least one nozzle, wherein the sprayer ring receives in the void a generally vertical tine on a rack positioned within the wash tub and attaches to the tine from a side of the sprayer ring, and wherein the sprayer ring is in fluid communication with the supply tube; and a fluid supply in fluid communication with the sprayer ring through the supply tube and configured to supply a fluid to the sprayer ring to spray the fluid onto utensils disposed within the wash tub.

27. The dishwasher of claim 26, wherein each of the one or more tines is solid.

28. The dishwasher of claim 26, wherein the sprayer ring attaches to the tine by snapping onto the tine.

* * * * *